United States Patent [19]

Lindtveit

[11] 4,392,796

[45] Jul. 12, 1983

[54] VALVE CONTROLLED REVERSIBLE PUMP WITH ANTICAVITATION MEANS

[75] Inventor: Herbert E. Lindtveit, Centerport, N.Y.

[73] Assignee: Sid Harvey, Inc., Valley Stream, N.Y.

[21] Appl. No.: 194,973

[22] Filed: Oct. 8, 1980

Related U.S. Application Data

[63] Continuation-in-part of Ser. No. 952,308, Oct. 18, 1978, Pat. No. 4,247,267.

[51] Int. Cl.[3] ..... F04C 2/10; F04C 15/02

[52] U.S. Cl. ..... 418/32; 418/170

[58] Field of Search ..... 418/32, 170; 417/315

[56] References Cited

U.S. PATENT DOCUMENTS

| | | | |
|---|---|---|---|
| 2,277,270 | 3/1942 | Schmitter et al. | 418/32 |
| 2,778,316 | 1/1957 | Haight et al. | 418/32 |
| 2,781,726 | 2/1957 | Bangs | 418/32 |
| 3,208,392 | 9/1965 | Garrison et al. | 418/32 |

FOREIGN PATENT DOCUMENTS

| | | | |
|---|---|---|---|
| 1042994 | 11/1958 | Fed. Rep. of Germany | 418/32 |
| 835686 | 5/1960 | United Kingdom | 418/32 |

*Primary Examiner*—John J. Vrablik

*Attorney, Agent, or Firm*—Cooper, Dunham, Clark, Griffin & Moran

[57] ABSTRACT

The pump drive shaft may rotate in either direction. The pump discharges liquid from the same port, regardless of the direction of rotation. A receiving port on the pump mounting pad is aligned with that discharge port. The pump includes a base plate, a pump plate and a cover plate, aligned with a stack. The pump has a single inlet diametrically opposite the point where the gears mesh. This inlet acts in either direction of rotation so that no valves are needed in the inlet passage. Two outlet ports are located respectively on opposite sides of the mesh point. All fluid passages and a valve means which selects one outlet port or the other, depending on the direction of rotation, are located in the base plate. All valves are simple structures trapped in chambers between the base plate and the pump plate, or between the base plate and the mounting pad. The inlet is made narrower than the teeth on the gears to prevent cavitation.

10 Claims, 12 Drawing Figures

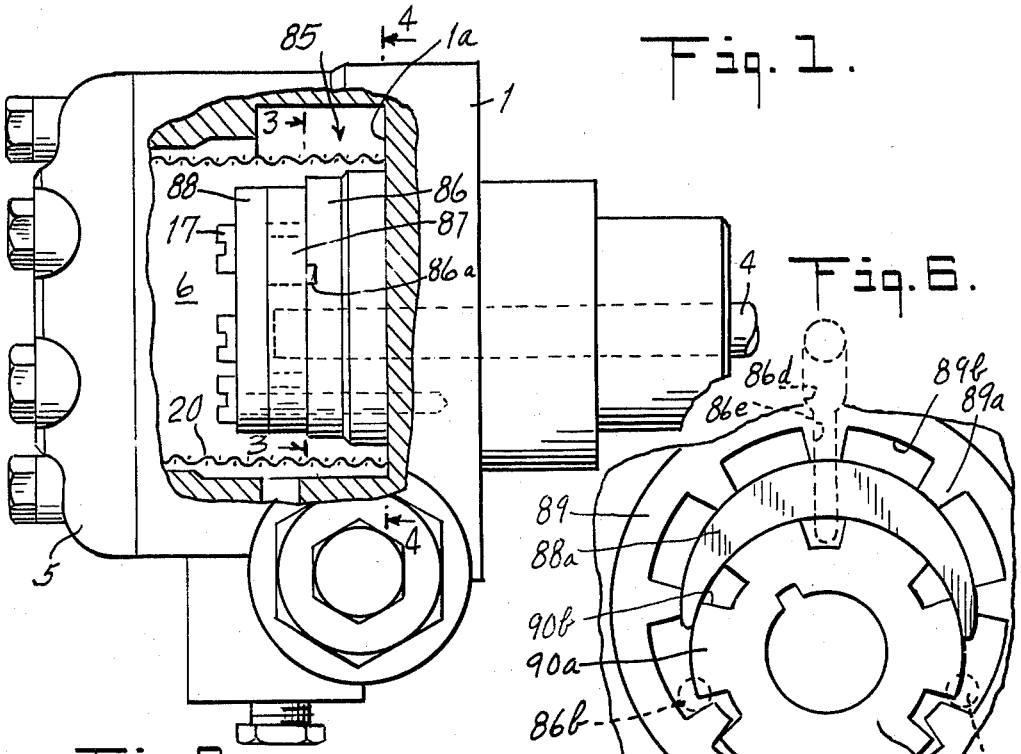
Fig. 1.
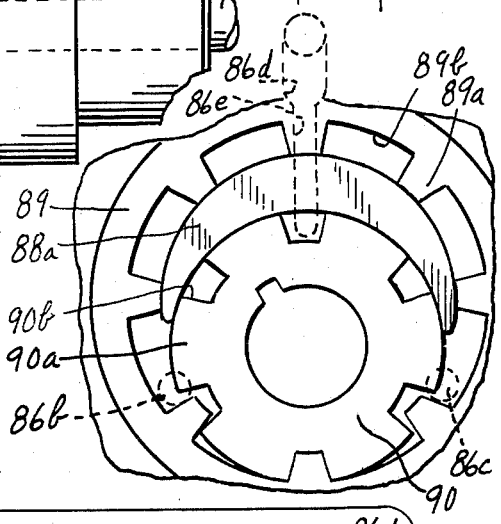
Fig. 6.
Fig. 2.
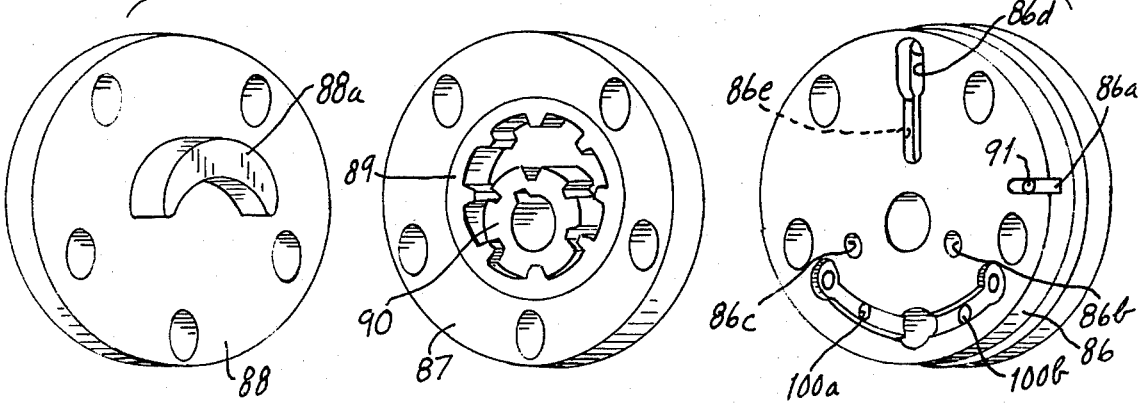
Fig. 3.
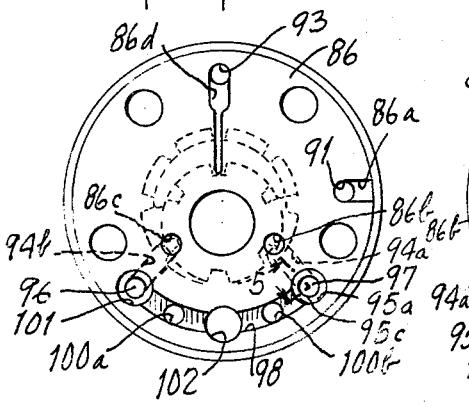
Fig. 4.
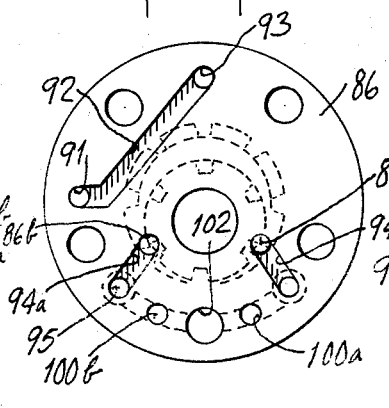
Fig. 5.
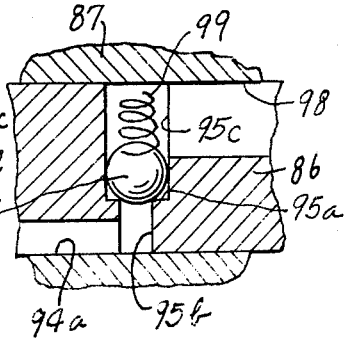

VALVE CONTROLLED REVERSIBLE PUMP WITH ANTICAVITATION MEANS

CROSS-REFERENCE

This application is a continuation-in-part of my application Ser. No. 952,308, filed Oct. 18, 1978, now U.S. Pat. No. 4,247,267, entitled Valve Controlled Reversible Pump.

BRIEF SUMMARY

The pumps described herein are intended as replacements for original equipment, for example, on oil burners. The pump drive shaft on some oil burners rotates clockwise, and on others it rotates counterclockwise. This replacement pump discharges liquid from one discharge port, regardless of the direction of rotation of the drive shaft. Furthermore, the port on the pump housing for receiving liquid from the pump may be located in different positions with respect to the drive shaft on different pump housings. This replacement pump is adaptable to deliver liquid to any of various discharge ports. In any particular pump, the discharge port selected is aligned with the receiving port of the pump housing when the pump is in place on its mounting pad. All other discharge ports are blocked.

The pump structures shown are simple and easy to mount on an oil burner or other device with which they are intended to be used. The pumps are quiet in operation, as is particularly required for use on domestic oil burners.

Pumps of the present invention comprise a base plate which engages the mounting pad of the pump housing, a pump plate which encloses the pump elements and a cover plate. The pump rotor has two outlets, only one of which is used for a selected direction of rotation. A valve mechanism responds to the pressures at the pump rotor outlets and directs the flow from the active rotor outlet to the discharge port. That valve mechanism is mounted within the base plate. The valves are simple discs or balls trapped in chambers and moved by fluid pressure to perform their control functions.

The gear pump illustrated is a crescent pump. A single inlet port is located diametrically opposite the point where the gear teeth mesh. This inlet port is used for both directions of rotation of the gears. Two outlet ports are located on either side of the mesh point, each outlet port being used for one direction of rotation only. As the gears rotate, a vacuum is developed in the spaces between the gear teeth as they travel from the point of disengagement of the gear teeth to the inlet port. There the evacuated spaces between the gear teeth are filled with liquid.

The inlet port is made narrower than the width of the teeth on the gears so that each gear tooth closes the inlet port completely and it is never possible for two consecutive spaces between teeth on that gear to be open to the inlet port at the same time. In prior art pumps having a single central inlet port, where such a relationship between the gear tooth width and the inlet port width did not exist, each empty space, as it registers with the inlet, may draw back some of the liquid from the preceding space which has been filled, and which is still in partial registry with the inlet. Hence, as the rotation continues, that preceding space is only partly filled with liquid and the remainder with vapor or a vacuum. This vapor or vacuum is suddenly collapsed as the gears continue to rotate and compress the space. Such a sudden collapse of a vacuum or vapor filled space causes cavitation with accompanying noise. This noise is avoided in accordance with the present invention by making the inlet port narrower than the gear teeth, so that each space between two gear teeth is completely filled with liquid at the inlet port and is then sealed from the inlet port before the next space registers with that port.

DRAWINGS

FIG. 1 is a view partly in elevation and partly in section of a pump assembly embodying the invention.

FIG. 2 is an exploded perspective view of the pump of FIG. 1, with the cover plate reversed.

FIG. 3 is a view taken on the line 3—3 of FIG. 1, showing the base plate, and with portions of the pump gears shown in dotted lines.

FIG. 4 is a view of the base plate of FIG. 3 taken on the line 4—4 of FIG. 1.

FIG. 5 is a sectional view taken on line 5—5 of FIG. 3.

FIG. 6 is a view of the pump rotor, taken on the line 3—3 of FIG. 1, but in the opposite direction from the arrows, and on a larger scale with the ports shown in dotted lines to illustrate the relationship between the width of the gear teeth and the width of the inlet port;

DETAILED DESCRIPTION

FIGS. 1–6

Figure 7:
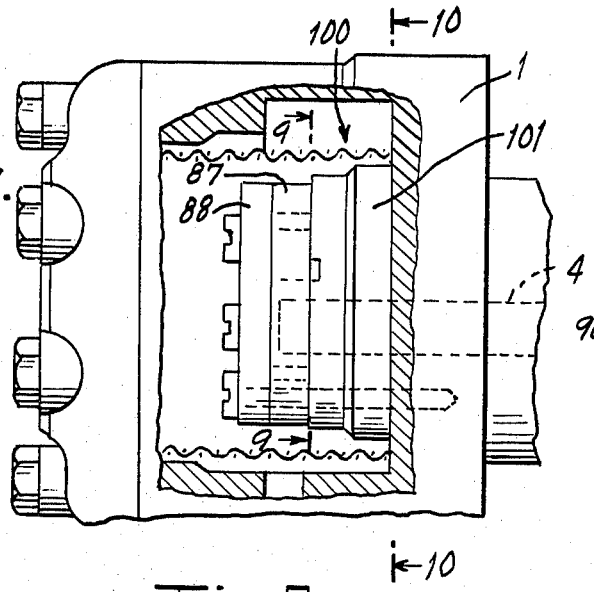
FIG. 7 is a view similar to FIG. 1, illustrating another embodiment of the invention.

FIG. 1 shows a complete pump assembly including a housing 1 having a mounting pad 1*a* on which a pump generally indicated at 85 is supported. The housing 1 encircles a drive shaft 4 adapted for connection to a motor-driven shaft on an oil burner. A cover 5 encloses the end of the housing 1 opposite the drive shaft 4. The housing 1 and the cover 5 enclose a chamber 6 filled with oil or other liquid to be pumped. A pressure regulating valve, of conventional construction, is located in another chamber of the housing 1 and delivers the liquid being pumped through a discharge conduit at substantially constant pressure.

The pump assembly comprises a base plate 86, a pump plate 87, and a cover plate 88.

The plates 86, 87 and 88 are stacked and are attached to the mounting pad 1*a* by means of screws 17. A screen 20 of conventional construction encloses the pump assembly. The base plate 86, as shown in FIGS. 2–4 includes five apertures to receive the screws 17, a central aperture to receive the shaft 4 and two discharge passages 100*a* and 100*b*, one of which communicates with a discharge line through a receiving port in the housing 1 (not shown).

In the pump 85, all of the fluid passages and two valves 96 and 97 which control the direction of the fluid flow are located in the base plate 86. The pump plate 87 encircles a ring gear 89 and a pinion gear 90 of a crescent pump. The cover plate 88 closes the outer side of the pump plate 87, and carries a crescent 88*a* which fills the space between the gears 89 and 90. An inlet 86*a* (FIG. 2) to the pump 85 is a groove in one side of the base plate 86. The inlet 86*a* connects with a series of tortuous passages and grooves in the base plate 86, including an axial passage 91, a groove 92 (FIG. 4) in the bottom face of the plate 86, an axial passage 93, and a groove 86*d*, 86*e* (FIGS. 2 and 3) in the outer face of the base plate. A shoulder separates the wide groove section 86*d* from the narrow groove section 86*e*. Most of the narrow groove section 86*e* is covered by the crescent 88*a*. The ends of the narrow groove section 86*e* are alternately covered and uncovered by the teeth of the rotating gears 89 and 90. The fluid enters the spaces between the gear teeth from the groove section 86*e* at the point of widest separation of the gears. Thus, the groove section 86*e* always acts as the inlet port for the pump rotors, in either direction of rotation. The rotation of the pump rotors 89 and 90 forces fluid out through one of two axial passages 86*b* or 86*c*, which are the outlet ports for the pump rotors, the particular port selected depending upon the direction of rotation of the pump.

Passage 86*b* communicates with a groove 94*a* on the inner face of plate 86 which in turn communicates with an axial passage 95. Passage 95 is a stepped passage having a shoulder 95*a* (FIG. 5) separating a narrow section 95*b* from a wide section 95*c*. The wide section 95*c* communicates with a groove 98. A ball valve 97 is trapped between the shoulder 95*a* and the pump plate 87. A spring 99 is retained between pump plate 87 and ball valve 97. The unstressed length of spring 99 is somewhat shorter than the spacing between plate 87 and ball valve 97 when the valve is seated against shoulder 95*a*. Spring 99 biases the ball valve 97 to a position near shoulder 95*a* so that any liquid movement from groove 98 through passage 95*c* toward groove 94*a* causes ball valve 97 to close against shoulder 95*a* thereby shutting off flow to groove 94*a*. When the flow is reversed by reversing the rotation of gears 89 and 90, air moving from passage 94*a* can open valve 97 without compressing the spring. Since the movement is horizontal, only small friction forces have to be overcome. Once air is purged from the pump, the pressure of the liquid being pumped compresses spring 99, and moves ball 97 far enough to cause the liquid to flow to groove 98. Groove 98 communicates with two discharge ports 100*a* and 100*b* one of which constitutes a delivery port and communicates with a receiving port (not shown) formed in the casing 1. In any particular installation, the unused port 100*a* or 100*b* is blocked. Note that groove 98 extends through one of the apertures, shown at 102, for receiving a mounting screw 17. The aperture is sufficiently larger than the screw 17 so that the screw does not appreciably restrict the flow through groove 98.

Passage 86*c* communicates with a valve-controlled flow path similar to that just described in connection with passage 86*b*, but not shown in as great detail in the drawing. The flow path from passage 86*c* may be traced through a groove 94*b*, a passage 101 corresponding in structure and function to passage 95, a valve 96 in that passage and groove 98 to the discharge ports 100*a* and 100*b*. Valve 96 corresponds in structure and function to valve 97, and is similarly biased by a spring (not shown).

OPERATION OF FIGS. 1-6

When the pump rotates clockwise as viewed in FIG. 3, liquid is pumped through inlet 86*a*, passage 91, groove 92, passage 93 and inlet port 86*e* and into the pump rotors. It is discharged by the pump rotors through the axial passage 86*b*, groove 94*a* and passage 95, where the liquid pressure is effective to move valve ball 97 off shoulder 95*a* so that liquid passes into groove 98. Flow is then from groove 98 into one of the passages 100*a* and 100*b* (whichever is aligned with the receiving port in casing 1) and into passage 101 where the liquid pressure is effective to move ball valve 96 against its seat and hold it there.

When the pump rotates in the counterclockwise direction, the fluid passes through the same inlet route as before. Liquid is then discharged by the gears through passage 86*c* and groove 94*b* to passage 101 where liquid pressure is effective to move ball valve 96 off its seat and thereby to allow flow to groove 98. Flow is then from groove 98 through passage 100*a* or 100*b* to the receiving port in casing 1. Liquid also flows from groove 98 into passage 95*c* where the liquid pressure is effective to move ball valve 97 against the shoulder 95*a* blocking flow to groove 94*a*.

The noise of operation of the pump 85 is reduced in the structure shown by the tortuous inlet passages 86*a*, 91, 92, 93, 86*d*, 86*e*. These tortuous passages reduce the transmission of noise through the liquid. The teeth of the pump gears 89 and 90 are wider than the pump inlet groove 86*e*, which is effective to minimize noise due to cavitation, as explained below.

FIG. 6 shows the relationship between the width of the inlet port 86*e* and the width of the teeth 89*a* on the ring gear 89 and teeth 90*a* on the pinion gear 90. As is conventional in crescent type gear pumps, the spaces 89*b* between the teeth on the ring gear 89 are about three times as wide as the teeth 89*a*. Conversely, on the meshing pinion gear 90, the teeth 90*a* are about three times as wide as the spaces between the teeth. Consequently, most of the liquid is pumped by the ring gear and a relatively smaller quantity (about one-third as much) is pumped by the pinion gear.

In accordance with the present invention, the inlet port 86*e* is made narrower than the teeth 89*a* on the ring gear, so that as the pump rotates, each space 89*b* between the teeth on the ring gear is sealed by the following gear tooth from the succeeding space.

In a crescent type gear pump, as shown, having a single central inlet port, the spaces between the gear teeth become evacuated as they move from the point of tooth engagement to the inlet port. If that port is wider than the teeth, as in prior art pumps, the port bridges a tooth, so that a space which has been filled at the inlet port is at least momentarily in fluid communication with the following evacuated space. This causes liquid to be drawn from the preceding filled space through the inlet port to the evacuated space. The previously filled space is thereby partially evacuated. As the rotation of the gear proceeds, the partial vacuum is eliminated by mechanical action, accompanied by noise. This is typical cavitation.

By making the inlet port narrower than the gear teeth, as in the pump disclosed herein, the initial opening of each evacuated space between the gear teeth to the inlet port cannot operate to draw liquid out of the preceding filled space. Hence, no cavitation develops in that preceding space.

Considering the pinion gear 90, the teeth 90*a* are obviously much wider than the spaces 90*b* between them, and hence there can be no transfer of liquid from a preceding filled space into the following evacuated space.

It might seem possible that, when one of the spaces 89*b* in the ring gear is first opened to an inlet port 86*e*, it might draw liquid through the inlet port from the space 90*b* in the pinion gear, which is at that time at least partially filled and is in registry with the inlet port. However, it has been found that with the arrangement illustrated there is no observable noise or wear due to cavitation. It is considered that the absence of cavitation at the pinion gear 90 is due to the fact that the distance from a space 90*b* through the inlet port 86*e* to a space 89*b* which is just opening into the inlet port is longer than the distance from that space 89*b* through the inlet port 86*e* to the wider groove 86*d* connected to the main supply of the liquid being pumped. There is consequently less resistance to flow encountered in filling the space 89*b* from the groove 86*d* than from the space 90*b* in the gear 90. No liquid is drawn from the space 90*b*, and hence there is no cavitation.

FIGS. 7–12

These figures illustrate another embodiment of the invention, in which a pump generally indicated at 100 is enclosed in the housing 1 and driven by the shaft 4. Those parts in these figures which correspond in structure and function to their counterparts in FIGS. 1–6 have been given the same reference numerals and will not be further described.

Figure 8:
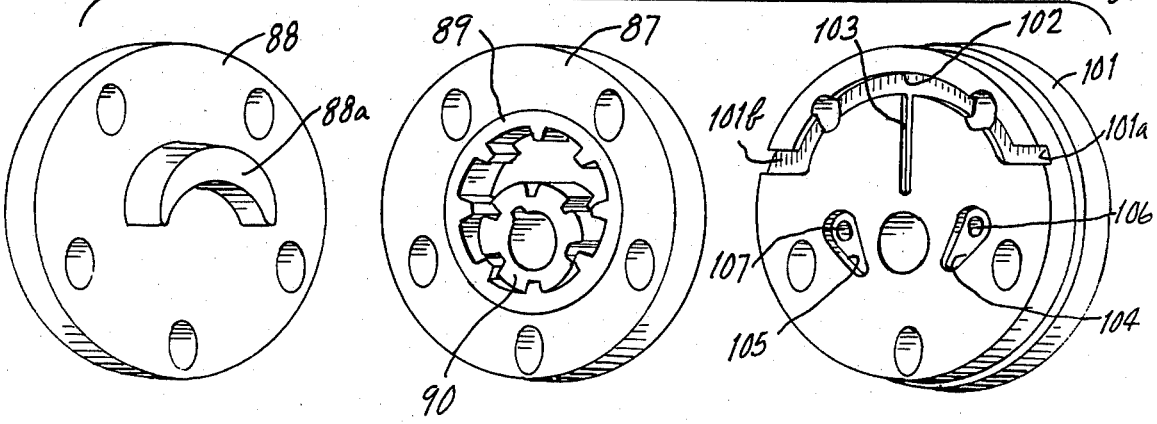
FIG. 8 is an exploded perspective view of the pump of FIG. 6, with the cover plate reversed.
Figure 9:
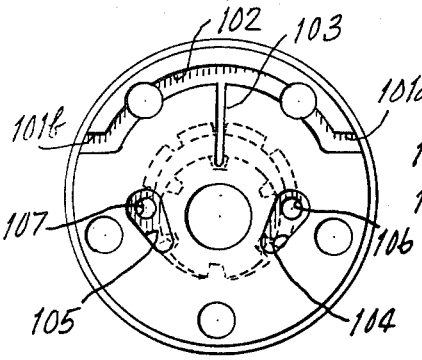
FIG. 9 is a view taken on the line 9—9 of FIG. 7, looking in the direction of the arrows.

The pump 100 includes a base plate 101, a pump plate 87 and a cover plate 88. The pump plate 87 encircles a ring gear 89 and a pinion gear 90 of a crescent pump. The base plate 101 includes two inlets 101*a* and 101*b* (FIG. 8) on opposite sides of the pump. These inlets are connected by a groove 102 in one face of the base plate 101. Groove 102 is concentric with the shaft 4 and communicates with a narrower groove 103 extending radially and serving as an inlet port for the pump. See FIGS. 8 and 9. The same face of the base plate 101 also includes recessed outlet ports 104 and 105 communicating with axially extending passages 106 and 107 respectively. The opposite ends of the passages 106 and 107 communicate with valve chambers 110 and 111 respectively (FIG. 10), defined in part by the mounting pad on the housing 1. A disk valve 112 is trapped in the chamber 110 and a disk valve 113 is trapped in the chamber 111. The chambers 110 and 111 are connected by an arcuate groove 114 in which is received a first leg of each of a pair of L-shaped leaf springs 115 and 116. The second leg of the L-shaped spring 116 is received in a recess 117 (FIG. 11) formed on the base plate 101. The second leg of spring 115 is received in a similar recess 118. The first leg of the spring 116 extends between the disk valve 113 and the housing 1 and is effective to separate the valve 113 from the housing 1 or from a gasket 120 which may be located between the base plate 101 and the housing 1. Leaf spring 115 is similarly located and similarly effective with respect to valve 112. The purpose of the leaf springs 115 and 116 is to keep the valves 112 and 113 from coming into contact with the adjacent surface of gasket 120 or the housing 1. In the event that the pump is run dry, one of the valves 112 and 113 might engage and stick against that surface. The leaf springs 115 and 116 are lightly self-biased to move the valves 112 and 113 away from the housing 1.

The outlet passages 104 and 105 are elongated in the direction of motion of the gear teeth so as to provide a ready outlet for all of the liquid between the gear teeth down to the point where they are fully engaged.

Figure 10:
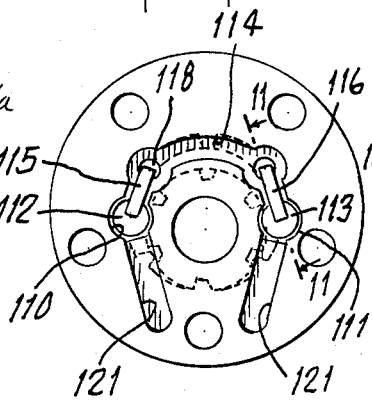
FIG. 10 is a view taken on the line 10—10 of FIG. 7, looking in the direction of the arrows.
Figure 11:
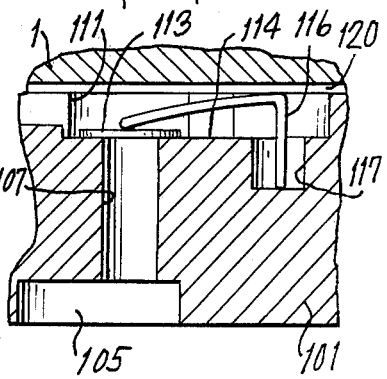
FIG. 11 is a fragmentary sectional view taken on the line 11—11 of FIG. 10.

Grooves 121 extend downwardly below the valve chambers 110 and 111, as viewed in FIG. 10. The grooves 121 provide communication between either chamber 110 or 111 and a receiving port (not shown) in the housing 1. In any installation only one of the grooves 121 is used, and the other is filled with a suitable block, e.g., of elastomeric material.

Figure 12:
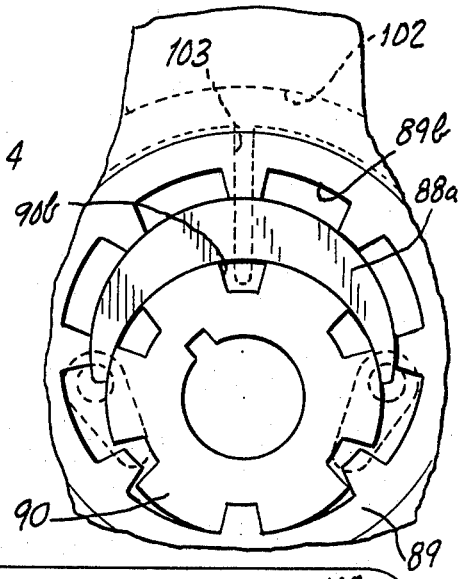
FIG. 12 is a view similar to FIG. 6, but showing the embodiment of FIGS. 7–11.

The action of the narrow inlet port 103 (FIG. 12) in preventing cavitation is similar to that of the narrow inlet port 86*e* in FIG. 6. Note that the distance along the port 103 from the radially outer edge of space 89*b* to the wide groove 102 is shorter than the distance from the inner edge of space 89*b* radially across the crescent 88*a* to the space 90*b*. The inlet port arrangement shown in FIG. 12 is just as effective in preventing noise and wear due to cavitation as the inlet port arrangement of FIG. 6.

The pumps illustrated are shown with two discharge ports, so that any such pump may be used with a pump housing having an oil receiving port at either of two locations. Commonly, a mounting pad in a pump housing has its receiving port located with respect to the drive shaft in either a right-hand or a symmetrical left-hand location. The discharge outlets in the pumps illustrated have been located with such conventional mounting pads in view. However, if more than two possible locations of the delivery passage may be encountered in a particular situation, additional discharge ports may be provided in the pumps. The ones not used are blocked at the mounting pad.

While the invention is illustrated herein as applied to a crescent pump, it is applicable to other pumps which utilize interengaging rotating members as pumping elements.

I claim:

1. A rotary pump apparatus adapted to be driven in either direction of rotation and to deliver liquid from the same delivery port for either direction of rotation, comprising:

a. a drive shaft adapted to be rotated in either direction;

b. a pair of meshing gears;

c. a single inlet port communicating with the spaces between the teeth of both gears at their points of widest separation; and d. two outlet ports respectively located adjacent each of the two possible points of initial engagement of the teeth and connected to said delivery port;

wherein the improvement comprises:

e. means effectively blocking liquid flow from a filled space at said inlet port toward a following evacuated space, said means preventing withdrawal of liquid from the filled space and subsequent cavitation, said blocking means comprising said inlet port, which is narrower than each tooth of each gear, so that each filled space is sealed from the inlet port by the following tooth before the next space to be filled registers with the port.

2. Rotary pump apparatus as in claim 1, including:

a. a base plate apertured to receive the shaft and including said delivery port;

b. a pump plate apertured to receive the shaft and the pair of gears; and c. a cover plate closing the side of the pump plate opposite the base plate; and d. a housing, including a mounting pad abutting the base plate, said inlet port being a radial groove in the surface of the base plate facing the pump plate.

3. Rotary pump apparatus as in claim 2, including:

a. first and second passages extending from said two points of initial engagement to the delivery port in the base plate; and b. a pair of valve means in the base plate and trapped between the base plate and the mounting pad, each of said valve means controlling one of said passages in response to the pressure of the liquid discharged by the pump, said pair of valve means being effective to open the passage from either point of initial engagement to the delivery port and to close the passage between the point of disengagement and the delivery port.

4. Rotary pump apparatus as in claim 3, in which:

a. each said valve means comprises a valve trapped between the base plate and the mounting pad in a recess in the base plate; and b. a leaf spring between the valve and the mounting plate to prevent sticking of the valve to the mounting pad.

5. Rotary pump apparatus as in claim 4, in which said leaf spring has one end bent over and received in a recess of the base plate.

6. Rotary pump apparatus as in claim 4, in which said leaf spring is self-biased to hold the valve in engagement with the base plate.

7. Rotary pump apparatus as in claim 1, in which:

a. the pump includes a ring gear, a pinion gear and a crescent separating the gears and abutting the base plate;

b. said inlet port is a groove in the base plate extending radially across the crescent and alternately opened to spaces between the gear teeth on the ring gear and the pinion gear as the gears rotate;

c. said inlet port communicates with a supply passage of greater cross-sectional area spaced radially outward from the peripheral edges of the spaces on the ring gear by a distance smaller than the radial distance across the crescent.

8. Rotary pump apparatus as in claim 7, in which:

a. said supply passage extends radially outward from the inlet port.

9. Rotary pump apparatus as in claim 7, in which the supply passage extends circumferentially from the inlet port.

10. Rotary pump apparatus as in claim 9, in which the supply passage extends circumferentially in both directions.

* * * * *